US006755885B2

(12) United States Patent
Vidarsson et al.

(10) Patent No.: US 6,755,885 B2
(45) Date of Patent: Jun. 29, 2004

(54) IRON POWDER COMPOSITION

(75) Inventors: Hilmar Vidarsson, Höganäs (SE); Per Knutsson, Ängelholm (SE)

(73) Assignee: Hëganäs AB, Hëganäs (SE)

( * ) Notice: Subject to any disclaimer, the term of this patent is extended or adjusted under 35 U.S.C. 154(b) by 162 days.

(21) Appl. No.: 10/201,974

(22) Filed: Jul. 25, 2002

(65) Prior Publication Data

US 2003/0094075 A1 May 22, 2003

Related U.S. Application Data

(63) Continuation-in-part of application No. 09/852,024, filed on May 10, 2001, now abandoned, which is a continuation of application No. PCT/SE02/00762, filed on Apr. 17, 2002.

(30) Foreign Application Priority Data

Apr. 17, 2001 (SE) ..... 0101344

(51) Int. Cl.[7] ..... B22F 1/00; B22F 3/00

(52) U.S. Cl. ..... 75/252; 419/10; 419/31; 419/36

(58) Field of Search ..... 75/252; 419/10, 419/31, 36; 508/554

(56) References Cited

U.S. PATENT DOCUMENTS 3,960,984 A * 6/1976 Kohan ..... 525/400
4,955,798 A 9/1990 Musella et al.
5,154,881 A 10/1992 Rutz et al.
5,368,630 A 11/1994 Luk
5,744,433 A 4/1998 Storström et al.
5,754,936 A * 5/1998 Jansson ..... 419/10
5,782,954 A 7/1998 Luk
5,926,686 A 7/1999 Engström et al.
6,511,945 B1 * 1/2003 Ramstedt ..... 508/151

FOREIGN PATENT DOCUMENTS

JP 4136104 5/1992

* cited by examiner

*Primary Examiner*—Ngoclan Mai
(74) *Attorney, Agent, or Firm*—Burns, Doane, Swecker & Mathis, L.L.P.

(57) ABSTRACT

A powder composition for warm compaction comprising an iron-based powder and a lubricant powder consisting essentially of an amide described by the following formula D—$C_m$—B—A—B—$C_m$—D wherein D is —H, COR, CNHR, wherein R is a straight or branched aliphatic or aromatic group including 2–21 C atoms; C is the group —NH $(CH)_n$ CO—; B is amino or carbonyl; A is alkylene having 4–16 C atoms optionally including up to 4 O atoms m is an integer 1–10 and n is an integer 5–11.

20 Claims, No Drawings

IRON POWDER COMPOSITION

This is a continuation-in-part of U.S. patent application Ser. No. 09/852,024, filed May 10, 2001 now abandoned; is a continuation of International Application No. PCT/SE02/00762 that designates the United States of America which was filed on Apr. 17, 2002 and was published in English on Oct. 24, 2002; and claims priority for Swedish Application No. 0101344-0, filed on Apr. 17, 2001.

FIELD OF THE INVENTION

The present invention relates to metal powder compositions. Particularly the invention relates to iron-based compositions suitable for compaction at elevated temperatures.

BACKGROUND OF THE INVENTION

The powder metallurgy art generally uses different standard temperature regimes for the compaction of a metal powder to form a metal component. These include chill-pressing (pressing below ambient temperatures), cold-pressing (pressing at ambient temperatures), hot-pressing (pressing at temperatures above those at which the metal powder is capable of retaining work-hardening), and warm-pressing (pressing at temperatures between cold-pressing and hot-pressing).

Distinct advantages arise by pressing at temperatures above ambient temperature. The tensile strength and work hardening rate of most metals is reduced with increasing temperatures, and improved density and strength can be attained at lower compaction pressures. The extremely elevated temperatures of hot-pressing, however, introduce processing problems and accelerate wear of the dies. Therefore, current efforts are being directed towards the development of metal compositions suitable for warm-pressing processes.

The U.S. Pat. No. 4,955,798 (Musella) describes warm compaction in general. According to this patent, lubricants generally used for cold compaction, e.g. zinc stearate, can be used for warm compaction as well. In practice, however, it has proved impossible to use zinc stearate or ethylene bisstearamide (commercially available as ACRAWAX®.), which at present are the lubricants most frequently used for cold compaction, for warm compaction. The problems, which arise, are due to difficulties in filling the die in a satisfactory manner.

The U.S. Pat. No. 5,744,433 (Storstrom et al) and U.S. Pat. No. 5,154,881 (Rutz) disclose metal powder compositions including amide lubricants, which are especially developed for warm compaction.

The lubricant according to the U.S. Pat. No. 5,744,433 contains an oligomer of amide type, which has a weight-average molecular weight $M_w$ of 30,000 at the most. Very high densities and green strengths may be obtained by warm compacting powder compositions when the lubricant has a molecular weight above 4000, the preferred lubricant molecule having a molecular weight of about 6500. It has however been found that this lubricant has a tendency of sticking to the die wall, which requires frequent cleaning of the die. Another disadvantage is that the obtained green bodies are stained.

In the U.S. Pat. No. 5,154,881 the amide lubricant consists of the reaction product of a monocarboxylic acid, a dicarboxylic acid and a diamine. The only lubricant tested according to this patent is ADVAWAX® 450, the composition of which is not described in detail but the reaction product obtained includes i.a. ethylene bisstearamide according to Chemis-CIVS. Our experience of this product is that it is difficult to obtain a constant composition and quality, which in turn may result in components of varying quality. This may cause problems when the lubricant is used in large scale industrial production.

OBJECTS OF THE INVENTION

An object of the present invention is to reduce or eliminate current problems associated with large scale production.

A second object is to provide a new type of lubricant useful in metal compositions intended for compaction at elevated temperatures.

A third object is to provide a metal powder for producing components without stains.

A fourth object is to provide a metal composition including lubricant, which during the compaction of the metal powder does not deposit on the die wall.

SUMMARY OF THE INVENTION

These objects are achieved by using a powder composition comprising an iron-based powder and new oligomer amide type lubricant. The composition may also include one or more additives, such as binders, flow agents, processing aids and hard phases.

The warm compaction may be performed by mixing an iron-based powder with the oligomer amide type lubricant and optionally a binder, preheating the powder composition and compacting the metal-powder composition in a preheated tool.

DETAILED DESCRIPTION OF THE INVENTION

The new amide type lubricant used according to the present invention may be represented by the following formula $$D—C_{ma}—B—A—B—C_{mb}—D$$

wherein

D is —H, COR, CNHR, wherein R is a straight or branched aliphatic or aromatic group including 2–21 C atoms C is the group —NH $(CH)_n$ CO—

B is amino or carbonyl

A is alkylen having 4–16 C atoms optionally including up to 4 O atoms ma is an integer 1–10 mb is an integer 1–10 n is an integer 5–11.

It is preferred that D is COR, wherein R is an aliphatic group 16–20 C atoms, C is —NH $(CH)_n$ CO— wherein n is 5 or 11; B is amino; A is alkylen having 6–14 C atoms optionally including up to 3 O atoms, and ma and mb which may be the same or different, is an integer 2–5.

Examples of preferred lubricants to be used in the iron based compositions according to the present invention are:

$$CH_3(CH_2)_{16}CO—[HN(CH_2)_{11}CO]_2—HN(CH_2)_{12}NH—[OC(CH_2)_{11}NH]_2—OC(CH_2)_{16}CH_3$$

$$CH_3(CH_2)_{16}CO—[HN(CH_2)_{11}CO]_2—HN(CH_2)_{12}NH—[OC(CH_2)_{11}NH]_3—OC(CH_2)_{16}CH_3$$

$$CH_3(CH_2)_{16}CO—[HN(CH_2)_{11}CO]_3—HN(CH_2)_{12}NH—[OC(CH_2)_{11}NH]_3—OC(CH_2)_{16}CH_3$$

$CH_3(CH_2)_{16}CO—[HN(CH_2)_{11}CO]_3—HN(CH_2)_{12}NH—[OC(CH_2)_{11}NH]_4—OC(CH_2)_{16}CH_3$ $CH_3(CH_2)_{16}CO—[HN(CH_2)_{11}CO]_4—HN(CH_2)_{12}NH—[OC(CH_2)_{11}NH]_4—OC(CH_2)_{16}CH_3$ $CH_3(CH_2)_{16}CO—[HN(CH_2)_{11}CO]_4—HN(CH_2)_{12}NH—[OC(CH_2)_{11}NH]_5—OC(CH_2)_{16}CH_3$ $CH_3(CH_2)_{16}CO—[HN(CH_2)_{11}CO]_5—HN(CH_2)_{12}NH—[OC(CH_2)_{11}NH]_5—OC(CH_2)_{16}CH_3$

Other examples are $CH_3)CO—HN(CH_2)_5CO—HN(CH_2)_2NH—OC(CH_2)_5NH—OC(CH_3)$ having the MW 370.49;

$CH_3(CH_2)_2OCO—HN(CH_2)_{11}CO—HN(CH_2)_{12}NH—OC(CH_2)_{11}NH—OC(CH_2)_{20}CH_3$ having the MW 1240.10

$CH_3(CH_2)_{20}CO—[HN(CH_2)_{11}CO]_{10}—HN(CH_2)_{12}NH—[OC(CH_2)_{11}NH]_{10}—OC(CH_2)_{20}CH_3$ having the MW 8738.04

$CH_3(CH_2)_4CO—[HN(CH_2)_{11}CO]_3—HN(CH_2)_{12}NH—[OC(CH_2)_{11}NH]_3—OC(CH_2)_4CH_3$ having the MW 1580.53

$CH_3(CH_2)_4CO—[HN(CH_2)_5CO]_7—HN(CH_2)_6NH—[OC(CH_2)_5NH]_7—OC(CH_2)_4CH_3$ having the MW 1980.86

$CH_3(CH_2)_{20}CO—[HN(CH_2)_5CO]_7—HN(CH_2)_6NH—[OC(CH_2)_5NH]_7—OC(CH_2)_{20}CH_3$ having the MW 2429.69 and $CH_3(CH_2)_{16}NH—[OC(CH_2)_{11}NH]_4—CO(CH_2)_{10}CO—[HN(CH_2)_{11}CO]_4—HN(CH_2)_{16}CH_3$ having the MW 2283.73

The chemical differences between the new lubricant and the lubricant described in the U.S. Pat. No. 5,744,433 are that the new molecule has a central diamine or diacid moiety and identical terminal groups on both ends. The chemical difference between the new lubricant and the lubricant described in the U.S. Pat. No. 5,154,881 is that the new lubricant molecule includes the unit $—NH(CH)_nCO—$. In contrast to the lubricant known from U.S. Pat. No. 5,154,881 no EBS is formed when the lubricant according to the present invention is prepared. EBS has the chemical formula $CH_3(CH_2)_{16}CO—HN(CH_2)_2NH—OC(CH_2)_{16}CH_3$) is a molecule without lactam units which is in contrast to the lubricants according to the present invention.

As regards the molecular weight of the new lubricant molecule it has been found that the preferred lubricants have a molecular weight between 1000 and 5000, most preferably between 1500 and 3000.

The lubricant molecule may be prepared according standard procedures for amide oligomer as described in e.g. "Principles of Polymerization" third edition by George Odian (John Wiley & Sons, Inc.). According to the present invention the lubricant preferably consists of at least 80% of the amide having the formula described above. Thus up to 20% by weight of other types of lubricants may be added, as long as the advantageous properties of the new lubricant is not detrimentally affected.

This lubricant, which is added to the iron-based powder is preferably in the form of a solid powder, can make up 0.1–1% by weight of the metal-powder composition, preferably 0.2–0.8% by weight, based on the total amount of the metal-powder composition. The possibility of using the lubricant according to the present invention in low amounts is an especially advantageous feature of the invention, since it enables high densities to be achieved.

As used in the description and the appended claims, the expression "iron-based powder" encompasses powder essentially made up of pure iron; iron powder that has been pre-alloyed with other substances improving the strength, the hardening properties, the electromagnetic properties or other desirable properties of the end products; and particles of iron mixed with particles of such alloying elements (diffusion annealed mixture or purely mechanical mixture). Examples of alloying elements are copper, molybdenum, chromium, manganese, phosphorus, carbon in the form of graphite, and tungsten, which are used either separately or in combination, e.g. in the form of compounds ($Fe_3P$ and FeMo). Unexpectedly good results are obtained when the lubricants according to the invention are used in combination with iron-based powders having high compressibility. Generally, such powders have a low carbon content, preferably below 0.04% by weight. Such powders include e.g. Distaloy AE, Astaloy Mo and ASC 100.29, all of which are commercially available from Hoganas AB, Sweden.

Apart from the iron-based powder and the lubricant, the new powder composition may contain one or more additives such as binders, flow agents, processing aids and hard phases.

The binder may be added to the powder composition in accordance with the method described in U.S. Pat. No. 5,368,630 (which is hereby incorporated by reference) and may be organic compounds such as cellulose ester resins, hydroxyalkyl cellulose resins having 1–4 carbon atoms in the alkyl group, or thermoplastic phenolic resins.

A type of flow agent, which can be used according to the present invention, is disclosed in the U.S. Pat. No. 5,782,954 (which is hereby incorporated by reference). The flow agent, which is preferably a silicon dioxide, is used in an amount from about 0.005 to about 2 percent by weight, preferably from about 0.01 to about 1 percent by weight, and more preferably from about 0.025 to about 0.5 percent by weight, based on the total weight of the metallurgical composition. Furthermore, the flow agent should have an average particle size below about 40 nanometers. Preferred silicon oxides are the silicon dioxide materials, both hydrophilic and hydrophobic forms, commercially available as the Aerosil line of silicon dioxides, such as the Aerosil 200 and R812 products, from Degussa Corporation.

The processing aids used in the metal-powder composition may consist of talc, forsterite, manganese sulphide, sulphur, molybdenum disulphide, boron nitride, tellurium, selenium, barium difluoride and calcium difluoride, which are used either separately or in combination.

The hard phases used in the metal-powder composition may consist of carbides of tungsten, vanadium, titanium, niobium, chromium, molybdenum, tantalum and zirconium, nitrides of aluminium, titanium, vanadium, molybdenum and chromium, $Al_2O_3$, and various ceramic materials.

The invention is further illustrated by the following examples, which are to be interpreted only as examples but should not limit the scope of protection.

EXAMPLE 1

The following tables disclose a comparison of properties between components prepared from powder mixtures including the lubricant according to the present invention and the amide type lubricant disclosed in the U.S. Pat. No. 5,744,433.

TABLE 1

| Lubricant | Compaction Pressure (MPa) | GD ($g/cm^3$) | Ejection Force ($N/mm^2$) | Ejection Energy ($J/cm^2$) | Spring-back (%) |
|---|---|---|---|---|---|
| Invention | 500 | 7.14 | 11.5 | 19.3 | 0.147 |
| " | 600 | 7.29 | 11.4 | 23.3 | 0.162 |
| " | 700 | 7.38 | 11.8 | 24.6 | 0.192 |
| Orgasol 3501* | 500 | 7.09 | 11.9 | 29.9 | 0.191 |
| | 600 | 7.22 | 13.8 | 40.0 | 0.187 |
| | 700 | 7.30 | 16.0 | 48.5 | 0.229 |

TABLE 2

| Lubricant | Compaction Pressure (MPa) | Appearance | |
|---|---|---|---|
| | | Green compact | Die Wall |
| Invention | 500 | No stains | No deposit |
| " | 600 | Few stains | No deposit |
| " | 700 | Few stains | No deposit |
| Orgasol 3501* | 500 | Many stains | Some deposit |
| | 600 | Many stains | More deposit |
| | 700 | Many stains | More deposit |

Temperature Powder/Die: 120° C./120° C.
*lubricant preferred according to U.S. Pat. No. 5,744,433

Temperature Powder/Die: 120° C./120° C. * lubricant preferred according to U.S. Pat. No. 5,744,433

The iron-based powder was Distaloy AE available from H öganäs AB, Sweden. This powder was mixed with 0.3% by weight of ultrafine graphite and 0.6% by weight of a lubricant according to the present invention. A flow enhancing agent Aerosil® 200 was added in an amount of 0.06% by weight.

As can be seen the new oligomer amide type lubricant according to the present invention is superior not only as regards the ejection force, the ejection energy, the spring-back but also when it comes to the appearance of the compacted component. Additionally the lubricant does not deposit on the die wall.

EXAMPLE 2

The following table discloses a comparison of properties between components prepared from powder mixtures including the lubricant according to the present invention and the amide type lubricant disclosed in the U.S. Pat. No. 5,154,881.

As can be seen the lubricant according to the present invention is superior as regards the ejection force, the ejection energy and the springback.

TABLE 3

| | GD ($g/cm^3$) | Ejection Force ($N/mm^2$) | Ejection Energy ($J/cm^2$) | Spring-back (%) |
|---|---|---|---|---|
| Lubricant according to the present invention | 7.46 | 9.7 | 20.9 | 0.121 |
| Lubricant according to U.S. Pat. No. 5,154,881 | 7.40 | 15.4 | 21.9 | 0.201 |

Compaction pressure 700 MPa
Temperature powder/Die 130° C./150° C.

Compaction pressure 700 MPa
Temperature powder/Die 130°0 C./150° C.

The iron-based powder was Distaloy AE available from H öganäs AB, Sweden.

This powder was mixed with 0.3% by weight of ultra-fine graphite and 0.6% by weight of a lubricant according to the present invention. A flow enhancing agent Aerosil was added in an amount of 0.06% by weight.

EXAMPLE 3

The following example discloses a comparison of densities of green bodies obtained with the oligomer amide lubricants which are used according to the present invention and which have different molecular weights.

The iron-based powder was Distaloy AE available from H öganäs AB, Sweden.

This powder was mixed with 0.3% by weight of ultra-fine graphite and 0.6% by weight of a lubricant according to the present invention. A flow enhancing agent Aerosil was added in an amount of 0.06% by weight.

The powder was heated to a temperature of 130° C. and the temperature of die was 150° C. The compaction pressure was 700 MPa.

| Molecular Weight of Lubricant | GD ($g/cm^3$) |
|---|---|
| 2000 | 7.44 |
| 3000 | 7.41 |
| 4000 | 7.31 |

If the molecular weight of the oligomer amide lubricant is lower than (about) 2000 the properties of the powder composition becomes worse with regards to flow, and the lubricant will have a tendency of sticking to the die wall and the surface of the ejected compact. The sticky nature of such surfaces increases the risk of formation of rough surfaces on the final part owing to powder which may be collected onto the ejected compact.

What is claimed is:

1. A powder composition for warm compaction comprising an iron-based powder and a lubricant powder, said lubricant consisting essentially of an amide represented by the following formula:

$$D—C_{ma}—B—A—C_{mb}—D,$$

wherein

D is —H, COR, CNHR, wherein R is a straight or branched aliphatic or aromatic group including 2–21 C atoms, C is the group —NH $(CH)_n$ CO—, B is amino or carbonyl, A is alkylene having 4–16 C atoms optionally including up to 4 O atoms, ma is an integer 1–10, mb is an integer 1–10, and n is an integer 5–11.

2. A powder composition according to claim 1, wherein D is COR, wherein R is an aliphatic group 16–20 C atoms, C is —NH $(CH)_n$ CO— wherein n is 5 or 11; B is amino; A is alkylene having 6–14 C atoms optionally including up to 3 O atoms, and ma and mb, respectively is an integer 2–5, whereby ma and mb may be the same or different.

3. A powder composition according to claim 1, wherein the lubricant consists of a compound selected from the group consisting of:

$CH_3(CH_2)_{16}CO—[HN(CH_2)_{11}CO]_2—HN(CH_2)_{12}NH—[OC(CH_2)_{11}NH]_2—OC(CH_2)_{16}CH_3$, $CH_3(CH_2)_{16}CO—[HN(CH_2)_{11}CO]_2—HN(CH_2)_{12}NH—[OC(CH_2)_{11}NH]_3—OC(CH_2)_{16}CH_3$, $CH_3(CH_2)_{16}CO—[HN(CH_2)_{11}CO]_3—HN(CH_2)_{12}NH—[OC(CH_3)_{11}NH]_3—OC(CH_2)_{16}CH_3$, $CH_3(CH_2)_{16}CO—[HN(CH_2)_{11}CO]_2—HN(CH_2)_{12}NH—[OC(CH_2)_{11}NH]_4—OC(CH_2)_{16}CH_3$, $CH_3(CH_2)_{16}CO—[HN(CH_2)_{11}CO]_4—HN(CH_2)_{12}NH—[OC(CH_2)_{11}NH]_4—OC(CH_2)_{16}CH_3$, $CH_3(CH_2)_{16}CO—[HN(CH_2)_{11}CO]_4—HN(CH_2)_{12}NH—[OC(CH_2)_{11}NH]_5—OC(CH_2)_{16}CH_3$, $CH_3(CH_2)_{16}CO—[HN(CH_2)_{11}CO]_5—HN(CH_2)_{12}NH—[OC(CH_2)_{11}NH]_5—OC(CH_2)_{16}CH_3$.

4. A powder composition according to claim 1, wherein said amide has a molecular weight of 1500 to 3000 and is present in said composition in an amount of less than 1% by weight.

5. A powder composition according to claim 1, wherein the lubricant powder is provided in a concentration 0.2 to 0.8% by weight of the composition.

6. A powder composition according to claim 1, which additionally contains one or more additives selected from the group consisting of binders, processing aids, and hard phases.

7. A powder composition according to claim 1, wherein said iron-based powder is compressible, and at least 80% by weight of said lubricant powder is made up of said amide.

8. A powder composition according to claim 1, wherein said composition is essentially free from ethylenebisstearamide.

9. A powder composition according to claim 1, wherein said iron-based powder has a carbon content of at most 0.04% by weight.

10. A method for producing sintered products comprising:

(a) mixing an iron-based powder with a lubricant powder as defined in claim 1;

(b) preheating the metal-powder composition, (c) compacting the metal-powder composition in a preheated tool, and (d) sintering the compacted metal-powder composition to form a sintered product.

11. A powder composition according to claim 2, wherein the lubricant consists of a compound selected from the group consisting of:

$CH_3(CH_2)_{16}CO—[HN(CH_2)_{11}CO]_2—HN(CH_2)_{12}NH—[OC(CH_2)_{11}NH]_2—OC(CH_2)_{16}CH_3$, $CH_3(CH_2)_{16}CO—[HN(CH_2)_{11}CO]_2—HN(CH_2)_{12}NH—[OC(CH_2)_{11}NH]_3—OC(CH_2)_{16}CH_3$, $CH_3(CH_2)_{16}CO—[HN(CH_2)_{11}CO]_2—HN(CH_2)_{12}NH—[OC(CH_2)_{11}NH]_3—OC(CH_2)_{16}CH_3$, $CH_3(CH_2)_{16}CO—[HN(CH_2)_{11}CO]_2—HN(CH_2)_{12}NH—[OC(CH_2)_{11}NH]_4—OC(CH_2)_{16}CH_3$, $CH_3(CH_2)_{16}CO—[HN(CH_2)_{11}CO]_4—HN(CH_2)_{12}NH—[OC(CH_2)_{11}NH]_4—OC(CH_2)_{16}CH_3$, $CH_3(CH_2)_{16}CO—[HN(CH_2)_{11}CO]_4—HN(CH_2)_{12}NH—[OC(CH_2)_{11}NH]_5—OC(CH_2)_{16}CH_3$, $CH_3(CH_2)_{16}CO—[HN(CH_2)_{11}CO]_5—HN(CH_2)_{12}NH—[OC(CH_2)_{11}NH]_5—OC(CH_2)_{16}CH_3$.

12. A powder composition according to claim 2, wherein said amide has a molecular weight of 1500 to 3000 and is present in said composition in an amount of less than 1% by weight.

13. A powder composition according to claim 3, wherein said amide has a molecular weight of 1500 to 3000 and is present in said composition in an amount of less than 1% by weight.

14. A powder composition according to claim 11, wherein said amide has a molecular weight of 1500 to 3000 and is present in said composition in an amount of less than 1% by weight.

15. A powder composition according to claim 2, wherein the lubricant powder is provided in a concentration 0.2 to 0.8% by weight of the composition.

16. A powder composition according to claim 2, which additionally contains one or more additives selected from the group consisting of binders, processing aids, and hard phases.

17. A powder composition according to claim 2, wherein said iron-based powder is compressible, and at least 80% by weight of said lubricant powder is made up of said amide.

18. A powder composition according to claim 2, wherein said composition is essentially free from ethylenebisstearamide.

19. A powder composition according to claim 2, wherein said iron-based powder has a carbon content of at most 0.04% by weight.

20. A method for producing sintered products in accordance with claim 10 wherein said sintering of (d) is carried out at a temperature above 1050° C.

* * * * *

UNITED STATES PATENT AND TRADEMARK OFFICE

CERTIFICATE OF CORRECTION

PATENT NO. : 6,755,885 B2
DATED : June 29, 2004
INVENTOR(S) : Hilmar Vidarsson et al.

It is certified that error appears in the above-identified patent and that said Letters Patent is hereby corrected as shown below:

Title page,
Item [73], Assignee, delete "Hëganäs, AB, Hëganäs (SE)" and insert
-- Höganäs AB, Höganäs (SE) --.

Signed and Sealed this

Twenty-first Day of September, 2004

JON W. DUDAS
*Director of the United States Patent and Trademark Office*